US006619185B2

(12) United States Patent
Gutsche

(10) Patent No.: US 6,619,185 B2
(45) Date of Patent: Sep. 16, 2003

(54) SAFETY CIRCUIT FOR AUTOMATIC ASSEMBLING MACHINE

(75) Inventor: Michael Gutsche, Wuerzburg (DE)

(73) Assignee: Preh-Werke GmbH & Co. KG, Bad Neustadt a.d. Saale (DE)

( * ) Notice: Subject to any disclaimer, the term of this patent is extended or adjusted under 35 U.S.C. 154(b) by 63 days.

(21) Appl. No.: 09/971,570

(22) Filed: Oct. 9, 2001

(65) Prior Publication Data

US 2002/0041230 A1 Apr. 11, 2002

(30) Foreign Application Priority Data

Oct. 11, 2000 (DE) ..... 100 50 542

(51) Int. Cl.[7] ..... F15B 11/08
(52) U.S. Cl. ..... 91/521; 91/445
(58) Field of Search ..... 91/445, 6, 521–523; 60/407, 412

(56) References Cited

U.S. PATENT DOCUMENTS 4,476,678 A * 10/1984 Hall ..... 91/6
4,763,560 A * 8/1988 Sasaki ..... 91/6
4,838,306 A * 6/1989 Horn et al. ..... 91/445
4,921,009 A * 5/1990 Adam ..... 60/409
5,269,098 A * 12/1993 Redman ..... 49/360

FOREIGN PATENT DOCUMENTS

DE 196 13 848 C2 9/1997
DE 100 01 735 A1 2/2001

* cited by examiner

*Primary Examiner*—Edward K. Look
*Assistant Examiner*—Igor Kershteyn
(74) *Attorney, Agent, or Firm*—Birch, Stewart, Kolasch & Birch, LLP

(57) ABSTRACT

A safety circuit for protecting against an inadvertent operation activation of a pneumatic drive of an automatic assembling machine has at least one vertical cylinder (1) and one horizontal cylinder (2), each being controlled by one of first and second multi-way valves (3, 4) and fed by a primary pneumatic circuit. Two further pneumatic control circuits (8,9) are included in the automatic assembling machine that are automatically switch into and out of the primary pneumatic circuit, wherein the at least one vertical cylinder (1) and the at least one horizontal cylinder (2), after the "switching into", either remains in its current position or moves to a rest position. Opened and closed switching of a pneumatic primary circuit is caused according to an activated mode-of-operation set by a system control (SPS) of the automatic assembling machine.

13 Claims, 3 Drawing Sheets

SAFETY CIRCUIT FOR AUTOMATIC ASSEMBLING MACHINE

BACKGROUND OF THE INVENTION

This application claims a priority from German Application 100 50 542.2, filing date Oct. 11, 2000, and the contents of that application are incorporated by reference herein.

Use of automatic assembling machines for automatically placing, or mounting, electrical elements on circuit boards and the like is well known. Movement of an assembling arm is carried out via a pneumatic drive; that is, by a cylinder controlled by routing valves. These routing valves can be 3/2 routing valves or 5/2 routing valves, with two 3/2 routing valves completely filling or exhausting air of the associated cylinder, while a 5/2 routing valve can only switch the direction. A pressurized air supply to a plurality of cylinders via the routing valves is provided via at least one main air valve.

Particularly during installation work on the assembling machines, including also repair work, work must be carried out with pressurized cylinders in a system.

German Patent Document DE 196 13 848 C2 discloses a safety circuit to control a hydraulic drive in which at least one safety circuit overlies a regulating circuit in such a manner that if the regulating circuit cuts off a driven part can only be controlled by the respective safety circuit. This safety circuit carries out a defined opening or closing. The hydraulically overlaid safety circuit assures that a hydraulic switch function is set in a defined manner, independently of the condition of the remainder of the system of the hydraulic circuit and its control elements, with the otherwise normal control operation via the regulating circuit being deactivated in a defined manner. The circuit condition of the control block and, therefore, the exciting condition of magnets are ignored.

Such a safety circuit cannot be used for an installation operation, because, in this regard, work must often be carried out in a system having pressurized cylinders. Further, a safety circuit having this structure for assembling machines is too expensive.

So that during adjustment work of assembling machines, with protection doors being open and with safety functions being intentionally bridged, no inadvertent activation of the cylinder takes place, a mandated level of safety must be created for installation personnel in accordance with European Community machine regulations. An inadvertent activation is particularly possible if there are errors in the control. In this regard, dangerous movements of the pressurized cylinders could take place.

Publication of German Patent Document DE 100 01 735 A1 discloses a protection apparatus for protecting against an inadvertent activation of operation of a machine assembly that has the purpose of assuring secure protection during installation and maintenance, as well as during repair work, in dangerous areas of machine apparatus. With the help of at least one decentralized control-panel element, a stationary control signal is created in dependence on a protection requirement and delivered to a central power switch, which is then opened.

Thus, it is an object of this invention to provide a safety circuit, as well as a method to control such a safety circuit, for an installation, or mounting, operation of an assembling machine that allows one to work thereon, even with pressurized drives with a disarmed, or bridged, protector.

SUMMARY OF THE INVENTION

According to principles of this invention, a safety circuit for protecting against an inadvertent activation of a pneumatic drive of an automatic assembling machine, of a type having at least one vertical cylinder and one horizontal cylinder, with each being controlled by a multi-way valve and fed by a primary pneumatic circuit, further includes two pneumatic control circuits that automatically switch into and out of the primary pneumatic circuit, such that the vertical cylinder and the horizontal cylinder, after the switching into, does one of remaining in its current position and moving to a rest position.

In a process of this invention, for the control of a safety circuit to protect against an inadvertent activation of a pneumatic drive of an automatic assembling machine, an opened and closed switching of a pneumatic primary circuit is caused by two pneumatic control circuits, respectively, according to an activated mode of operation set by a system control (SPS) of the automatic assembling machine, with the two safety control circuits not being activated during normal operation with an existing protection and a closed protective door, but the safety control circuits being activated in any one of the following circumstances:

- during normal operation without a protection being present;
- upon the protective door (SÜ) being opened and there being a closed protective bridging;
- upon an EMERGENCY-OFF with an open contact (PNOZ) of an EMERGENCY-OFF protection on the automatic assembling machine, and
- during installation without protection and with protection bridging as well as another closed contact (EB).

It is provided that a safety circuit comprising two pneumatic control circuits are included in an assembling machine that are switched into and out of a pneumatic primary circuit of drives, that is of cylinders, of the assembling machine, depending on the type of operation. The safety circuit should have particular influence on the system during installation operations and should also automatically counter errors in the control, so that, for controlling, in addition to the SPS (Memory Programmable Control), all parts cooperating with the SPS, such as valves or relay circuits for example, play important roles.

The additional pneumatic control circuits have at least one control-path valve, with two openable check valves for each cylinder.

Control of the check valves takes place via the control-path valve in each control circuit that is controlled by a hardware-structured electronic logic, with additional contactors being used on existing switches, or protectors.

This logic is adapted to the respective type of operation, so that various safety functions can be realized depending on the type of operation. In addition a further protection can be included in the safety circuits to monitor the electrical voltage supply and an additional pressure monitor, which is a pneumatic-electrical converter, for recognizing a failure (disappearance) of a pressurized-air supply.

An additional software-type monitoring of the pneumatic function in the pneumatic circuits takes place through pressure monitors that deliver signals that are evaluated by the SPS. Thus, high resistance to errors is achieved, meeting DIN EN 954-1.

Further enhancements of the invention are described.

For example, a uniform color marking of one or both of the additional pneumatic control circuits by use of colored hoses is provided. In this manner, the functions can be more easily arranged, with, for example, the red hoses being for closing the line, that is locking the pressure in, and the blue hoses for exhausting. Also, retrofit changes, for example adding a drive to the system by changing the hoses on the control ports of the check valves, are possible, with which, among other things, various dangers can be reacted to, even on site upon placing a machine in operation.

This safety circuit realizes in an uncomplicated manner a pressure-free switching of most drives as well as pressurized-air trapping of all relevant drives upon a danger-preventative safety measure "MACHINE-STOP" without protection bridging (for example upon "EMERGENCY OUT" or "OPEN PROTECTIVE DOOR").

By pressurized-air trapping upon the safety measure MACHINE-STOP, a protection against the falling of a load, for example, or a sudden stopping of quick movements can be achieved.

During operation with protection bridging, all drives are closed, so that an inadvertent switching of the path-valves in the primary pneumatic circuit, for example because of control errors, does not result in dangerous movements of drives.

DETAILED DESCRIPTION OF THE INVENTION

Figure 1:
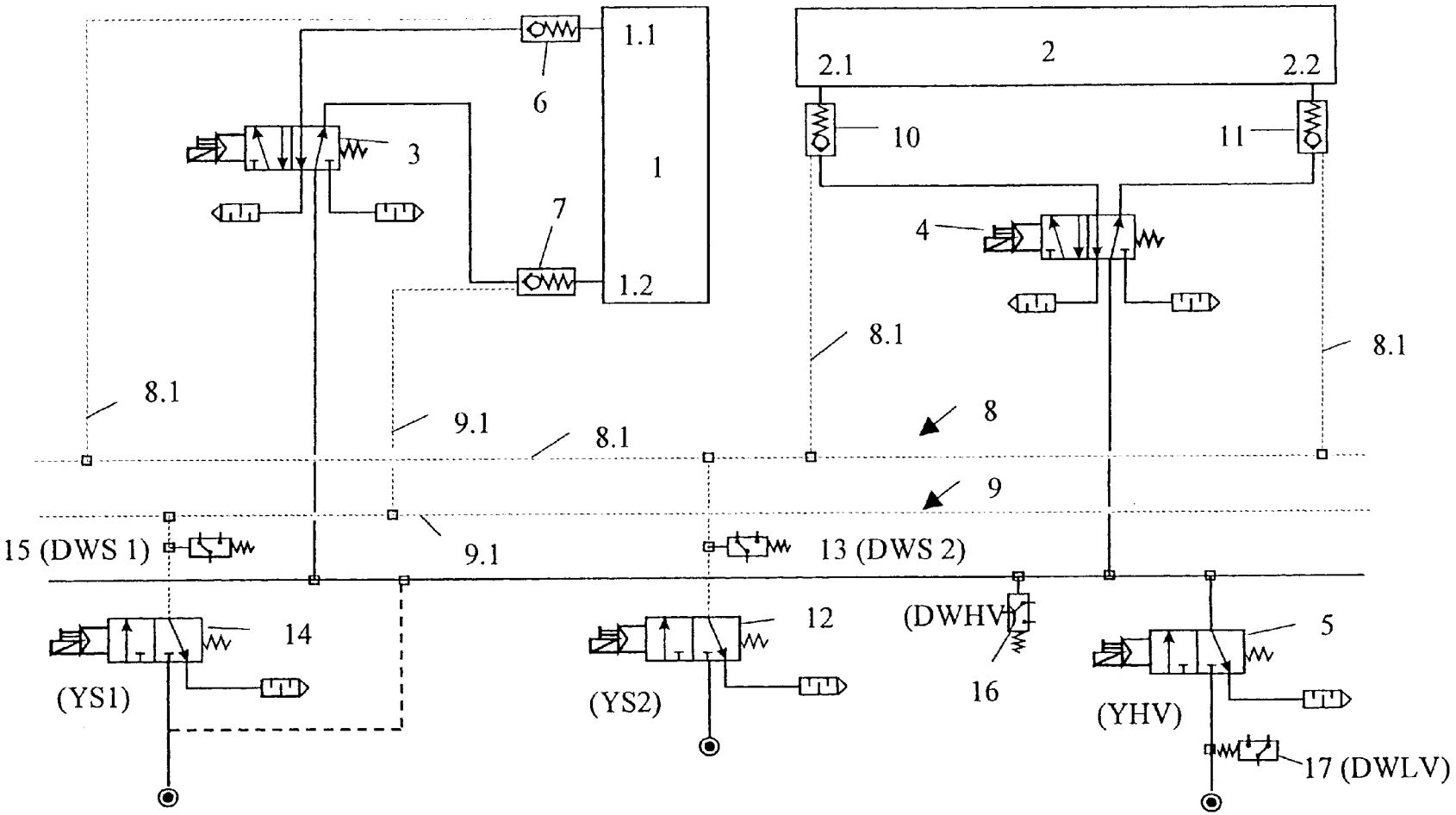
FIG. 1 is a schematic drawing of a safety pneumatic circuit of this invention for a vertical cylinder and a horizontal cylinder.

FIG. 1 depicts in a simplified manner a protective device for a vertical cylinder 1 and a horizontal cylinder 2 of an automatic assembling machine that is not shown in further detail. As is well known, a plurality of vertical cylinders and horizontal cylinders are present in automatic assembling machines, or modules.

For providing an overall understanding, the protective apparatus is described using two cylinders, the vertical cylinder 1 and the horizontal cylinder 2. Vertical movements, that is lifting movements, are carried out by the vertical cylinder 1 and horizontal movements by the horizontal cylinder 2. A multi-way valve 3, here a 5/2-way valve, is coupled to the vertical cylinder 1 in a known manner, for switching an available system pressure to one of two cylinder chambers of the vertical cylinder 1.

The horizontal cylinder 2 also has a multi-way valve 4 for turning on and maintaining a working pressure in the horizontal cylinder 2. The multi-way valve 4 is also here preferably a 5/2-way valve.

A pressurized air supply for the vertical cylinder 1 and the horizontal cylinder 2 in a primary pneumatic circuit for the system, or module, is provided via a common main air valve (YHV) 5. Additionally, a pressure monitor (DWLV) 17 is coupled in serially before the main valve 5, with which a hardware-type control of available air pressure is possible.

To protect against an unintended activation of the vertical cylinder 1 and the horizontal cylinder 2, a safety control circuit, including two separate pneumatic control circuits 8 and 9 for each module, is provided in the preferred embodiment; in each separate pneumatic control circuit 8 and 9 there being coupled a respective control-path valve 12, 14. The control-path valve 12 is, in this regard, coupled to the control circuit 8 via a control line 8.1 with, preferably, a pressure monitor 13 (DWS2) being coupled serially behind the control-path valve 12. With its other port, the control-path valve 12 is coupled to a separate pressurized air port, for example, to a pressurized-air port in front of the main air valve 5. The other control-path valve 14 is coupled into the control circuit 9 by a control line 9.1. Also here, a pressure monitor 15 (VWS1) is preferably coupled in, serially after the control-path valve 14. Another port of the control-path valve 14 is preferably coupled with the primary pneumatic circuit after the main air valve 5, which provides a heightened safety of the protective apparatus. It is, however, also possible for this port to be coupled to a separate pressurized air supply in front of the main valve 5.

Each of the vertical cylinders 1 is additionally coupled with two openable, or un-lockable, check valves, here HGL-valves 6 and 7. The HGL-valve 6 is located between an upper port 1.1 of the vertical cylinder 1 and the 5/2-way valve 3, the other HGL-valve 7 is coupled between a lower port 1.2 of the vertical cylinder 1 and the 5/2-way valve 3. Additionally, a control port of the upper HGL-valve 6 is steered through the control line 8.1 of the control circuit 8 and a control port of the lower HOL-valve 7 is steered through the control line 9.1 of the control circuit 9.

Each of the horizontal cylinders 2 also has two HGL-valves 10 and 11 (check valves) between the 5/2-way valve 4 and the ports 2.1, 2.2, with the HGL-valve 10 being coupled to the port 2.1 and the HGL-valve 11 being coupled to the port 2.2 of the horizontal cylinder. Both of the HGL-valves 10, 11 are, preferably, coupled to the control line 8.1.

With the help of the two control-path valves 12, 14, all of the HGL-valves 6, 7, 10, 11 of all the cylinders 1, 2 can be additionally controlled, with all of the upper ports 1.1 of the vertical cylinder 1 and all ports 2.1, 2.2 of the horizontal cylinder 2 being unlocked, or released (opened), via the control circuit 8 and all of the lower ports 1.2 of the vertical cylinder 1 in the module being released via the control circuit 9, so that, in this manner, it can be avoided that an undesired residual energy remains in the horizontal cylinders 2. Additionally, the upper cylinder chamber of the vertical cylinder 1 will be exhausted so that also here no residual energy remains (will still be carried out).

Figure 2:
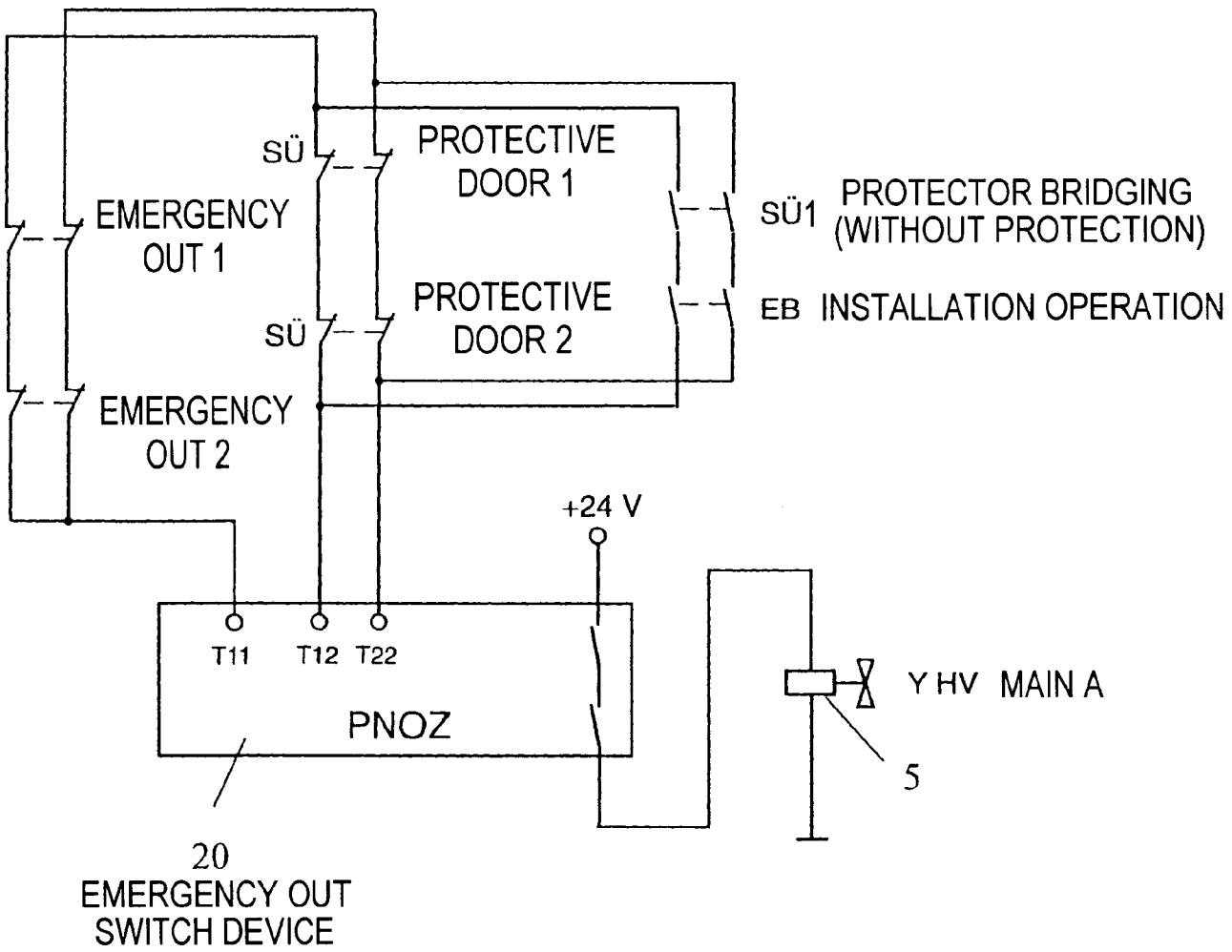
FIG. 2 is a conceptual electrical schematic circuit/block diagram in one embodiment of this invention, which is similar to that of the prior art, of a portion of an electrical circuit for controlling a main air valve.
Figure 3:
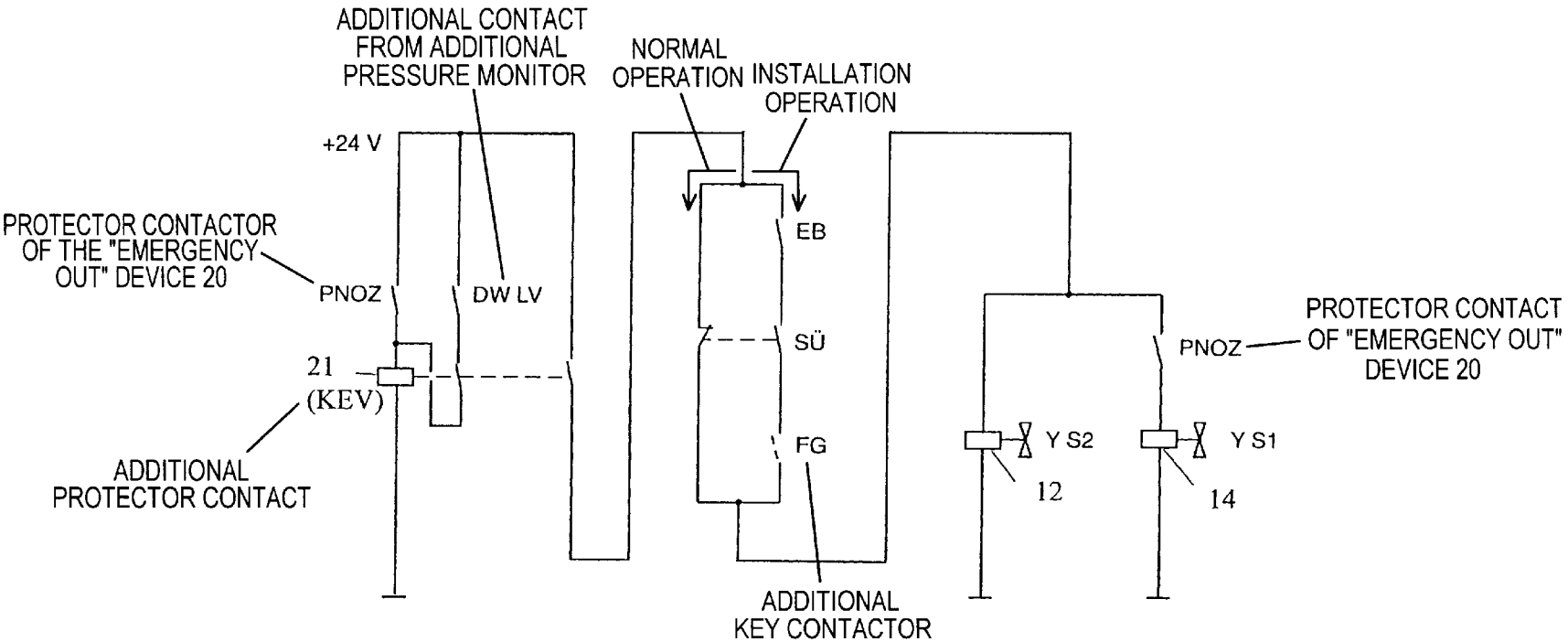
FIG. 3 is an electrical schematic circuit diagram, in an embodiment of the invention, of a portion of the circuit for controlling control-path valves of two pneumatic control valves of this invention.

For various modes of operation and operational conditions, it is now provided, depending on necessity, that the working capability of the vertical cylinder 1 and/or of the horizontal cylinder 2 is influenced via the two control circuits 8, 9 as is shown in FIG. 2 in connection with FIG. 3.

During normal operation, the 5/2-way valves 3, 4 in the primary circuit, supplied via the main air valve 5 (YHV) are controlled in a known manner for respectively adjusting the respective cylinders 1, 2 via the system control (SPS). A protection bridging contact SÜ, that is, a key-operated switch position "with protection", is closed, by which the individual contactors "INSTALLATION OPERATION" EB, protective bridging SÜ1 (that is a key switch position "WITHOUT PROTECTION" ), as well as an additional contactor FG (which is shown in the embodiment of FIG. 3) of an enabling key, are bridged, or shorted. This function is assured so long as the protector bridging SÜ1 is not moved.

The HGL-valves 6, 7 and 10, 11 are, in this regard, continually opened, the control-path valves 12, 14 are provided with pressurized air, and the separate control circuits 8, 9 themselves, however, provide no protective function.

Even during this type of operation, the safety circuit carries out additional monitoring of the general pressurized air supply in the module through a hardware-type inquiry of the pressure monitor 17(BWLV). If the pressurized air fails, a protector contactor 21 used for monitoring the electrical supply voltage is switched, that is it drops out, as soon as the protective doors are opened. The control-path valves 12, 14 receive no current flow; the protective apparatus is active.

During "PROTECTIVE STOP" in normal operation, that is, upon opening of a protective door or upon an "EMERGENCY-OUT" during normal operation, a "MODULE-OUT" is triggered for activating the protective apparatus, whereby the protective circuit is switched onto the primary pneumatic circuit. An "EMERGENCY-OUT" switch device 20 (PNOZ) coupled in the module thereby drops out, whereby the main air valve 5 is turned off, and the primary pneumatic circuit of the vertical cylinder 1 is partially exhausted, and the horizontal cylinder 2 is completely exhausted. The control-path valve 12 continues to receive flow, whereby the upper port 1.1 of the vertical cylinder 1 and the ports 2.1, 2.2 of the horizontal cylinder 2 are exhausted by the respectively opened HGL-valves 6, 10, 11. By providing current flow to the control-path valve 12: air is provided to the control circuit 8; the HGL-valves 6, 10, 11 connected thereto receive the control signal "OPEN", with the cylinder chambers of the horizontal cylinder 2 and the upper cylinder chambers of the vertical cylinders 1 being opened through to the main air valve 5. Simultaneously, as can be seen in FIG. 3, the control-path valve 14 receives no flow and thus is closed, so that the vertical cylinder 1 is closed at its lower port 1.2 via the HGL-valve 7. The lower cylinder chamber of the vertical cylinder 1 remains in a fixed position, and thereby under pressure (pressurized-air closed), which prevents the falling of a load (not shown in detail) linked to the vertical cylinder 1. By exhausting via the main air valve 5, or a quick-exhaust valve that is not shown which can be additionally integrated into the module, a quick stoppage of a dangerous movement during "protective-stop" and "emergency-out" results.

Additionally to these modes of operation, the protective apparatus functions also during other operational conditions, such as "INSTALLATION OPERATION" (EB) or selected "PROTECTIVE BRIDGING" (SÜ1).

During installation work, with a bridging of the protective-door function, that is, during a manner of operation "WITHOUT PROTECTION", both control-path valves 12, 14 are taken out of the system by closing the individual contacts EB and SÜ1 and opening the contacts SÜ, which is recognized by the SPS, whereby the control-path valves 12, 14 receive no current, and the vertical cylinder 1, as well as the horizontal cylinder 2, remain in their instant positions under coupled pressure. In a particular embodiment, upon the presence of an additional key, "release" (FG), which, for example, can be integrated into a separate control panel unit (not shown in greater detail), a predetermined cylinder 1, 2, for example the vertical cylinder 1, can be individually controlled, with movement release for all cylinders 1, 2 of the module being activated via the key FG, that is, all HGL-valves 6, 7 and 10, 11 for all cylinders 1, 2 are opened.

Not until manipulation of this key FG (release) can the vertical cylinder 1 and the horizontal cylinder 2 be thereby moved by current to the control-path valves 12, 14. If such a key FG is not provided during protector bridging, movement of the cylinders 1, 2 can only be carried out if the protective doors are closed.

Upon failure of the electrical voltage supply, the protector contactor 21 (KEV) integrated into the module falls out. If the protective door is open without the protector bridging, the contact SÜ is opened, with the control-path valve 12, along with the control-path valve 14, no longer receiving a current. Thus, pressure (pressurized air coupled in) remains in all vertical cylinders 1 and in all horizontal cylinders 2 in order to avoid undesired activation upon a sudden switching on of the voltage supply. Such discontinuance can come about, for example, because of a wire break or a complete short-lived current failure.

Further, in order to create a complex safety circuit, in addition to monitoring the presence of the energy supply (EV), the presence of pressurized air in the individual pneumatic circuits can be monitored. This monitoring is carried out during all types of operations and operational conditions. In order to do this, the SPS uses software to evaluate electrical signals of the pressure monitors 13, 15, 16 and 17, which are electrically coupled to SPS inputs.

Through this protective apparatus, all necessary conditions are thus met. No undesired cylinder movements can be carried out while installation personnel are in dangerous areas, that is, inside the automatic assembling machine. Nevertheless, the installation personnel can be in dangerous areas if the cylinders 1, 2 are pressurized in end positions. By means of the safety apparatus that is switched into the primary pneumatic circuit in the described particular cases, an inadvertent cylinder movement because of a control mistake is avoided. Simultaneously, installation personnel are able to intentionally cause individual cylinder movements.

A further beneficial embodiment comes about if the control lines 8.1, 9.1 and, therefore, also the control circuits 8, 9 in the automatic assembling machine, are laid using color-distinguishing markings and are coupled with associated ports. This allows a quick arranging of the functions. In this manner, the control circuit 8 can be characterized by having blue control lines 8.1, and the control circuit 9 can have red control lines 9.1. Thus, it is easy to recognize which ports must be exhausted and which closed.

It should be understood that other changes and modifications are also possible within the scope of the invention as can be understood by one of ordinary skill in the art from the specific embodiments described. Thus, openable check valves of the type already present in the primary pneumatic circuit can be used in the structure of the additional control circuits 8, 9. Also, it is possible to couple the ports 2.1, 2.2 of the horizontal cylinder 2 with the control line 9.1 of the second control circuit 9 so that the HGL-valves 10, 11 do not open the horizontal cylinder 2, rather, they close, or trap the pressurized air. This pressurized-air closing brings about, in turn, a freezing of the horizontal cylinder 2.

The software-type, as well as the hardware-type, monitoring can also be carried out by a control-PC or a similar routine instead by the SPS. Further, the safety circuit can be integrated into one or more prepackaged safety circuit devices, including the monitoring. As has already been described, one of the two control circuits of an individual module can be left out. Then all cylinder chambers of the vertical cylinder 1 and the horizontal cylinder 2 of the module will be exhausted or closed upon the operation "PROTECTIVE STOP". In the variant in which all cylinder chambers are exhausted, only the control circuit 8 is provided; for the variant where all cylinder chambers are closed, only the control circuit 9 is provided. Also, instead of the so-called HGL-valves, stop valves, gate valves, and so forth can be used.

I claim:

1. A safety circuit for protecting against an inadvertent operation activation of a pneumatic drive of an automatic assembling machine having at least one vertical cylinder (1) and one horizontal cylinder (2), each controlled by one of first and second multi-way valves (3, 4) and fed by a primary pneumatic circuit, wherein:

two further pneumatic control circuits (8, 9) are included in the automatic assembling machine that automatically switch into and out of the primary pneumatic circuit, wherein the at least one vertical cylinder (1) and the at least one horizontal cylinder (2), after the "switching into", does one of remaining in its current position and moving to a rest position.

2. The safety circuit of claim 1, wherein at least one control-path valve (12, 14) is included in each control circuit (8, 9) that respectively operates on at least two openable check valves (6, 7 and 10, 11) of each of the respective vertical cylinder (1) and horizontal cylinder (2).

3. The safety circuit of claim 2, wherein a first check valve (6) of the openable check valves is positioned between an upper port (1.1) of the vertical cylinder (2) and the first multi-way valve (3), a second check valve (7) is coupled between a lower port (1.2) of the vertical cylinder (1) and the first multi-way valve (3), a control port of the first check valve (6) is linked to a control line (8.1) of the first control circuit (8) and a control port of the second check valve (7) is linked to a control line (9.1) of the second control circuit (9), the two other check valves (10, 11) are respectively coupled between two ports (2.1, 2.2) of the horizontal cylinder (2) and the second multi-way valve (4) of the horizontal cylinder (2), with the first of these two check valves (10) being coupled with the control line (8.1) of the first control circuit (8) and the second check valve (11) thereof being coupled to the control line (8.1) of the first control circuit (8).

4. The safety circuit of claim 3, wherein there is a pressure monitor (13) in the control line (8.1) before the control-path valve (12) of the first control circuit (8) and a further pressure monitor (15) is arranged in the control line (9.1) after the control-path valve (14) of the second control circuit (9), with the pressure monitors (13, 15) being electrically coupled with a system control (SPS) of the automatic assembling machine.

5. The safety circuit of claim 3, wherein the control line (8.1) of the first control circuit (8) has a different color marking than does the control line (9.1) of the second control circuit (9).

6. The safety circuit of claim 5, wherein the control line (8.1) of the first control circuit (8) is marked in blue and the control line (9.1) of the second control circuit (9) is marked in red.

7. The safety circuit of claim 4, wherein an additional protector contactor (21) is coupled in the safety circuit to be electrically coupled with the system control (SPS) and with which, additionally, a presence of pressurized air and an electrical voltage supply of the automatic assembling machine is regulated.

8. The safety circuit of claim 1, wherein the at least one vertical cylinder (1) and the at least one horizontal cylinder (2) are at least partially exhausted.

9. The safety circuit of claim 1, wherein a release key (FB) is provided for individually controlling a frozen cylinder (1, 2) when a protection bridging (SÜ1) is activated.

10. A process for the control of a safety circuit to protect against an inadvertent activation of a pneumatic drive of an automatic assembling machine, wherein an opened and closed switching of a pneumatic primary circuit is caused by two pneumatic control circuits (8, 9), respectively, according to an activated mode-of-operation set by a system control (SPS) of the automatic assembling machine, with the safety circuit not being activated during normal operation with an existing protection and a closed protective door (SÜ), while the safety circuit is activated in any one of the following circumstances:

during normal operation without a protection being present, upon the protective door (SÜ) being open and there being a closed protection bridging (SÜ1);

upon an EMERGENCY-OFF with an open contact (PNOZ) of an EMERGENCY-OFF protection (20) on the automatic assembling machine; and during installation without protection and with protection bridging (SÜ1) as well as a closed contact (EB).

11. The process of claim 10, wherein during installation work without protection, at least one vertical cylinder and at least one horizontal cylinder (1, 2) can be individually controlled via an additional key (FG), with movement of the vertical cylinder (1) and the horizontal cylinder (2) not taking place until the key (FG) is manipulated.

12. The process of claim 10, wherein when an electrical voltage supply fails, an electrical supply monitoring protector contactor (21) falls out so that the safety circuit is switched in.

13. The process of claim 10, wherein the monitoring of an overall pressurized-air supply is carried out by a pressure monitor (17) and the individual pneumatic control circuits (8, 9) by respective monitors (13, 15, 16), with these monitors being electrically coupled to the system control (SPS).

* * * * *